United States Patent [19]

Barradas et al.

[11] 4,192,328

[45] Mar. 11, 1980

[54] CLAMPING ARM MECHANISM FOR CURLING IRON

[76] Inventors: George Barradas, 15 Riverview Ct., Glenville, Conn. 06830; Michael W. Hetherington, 29 Pringle Ave., Markham, Ontario, Canada

[21] Appl. No.: 911,521

[22] Filed: Jun. 1, 1978

[51] Int. Cl.[2] ..... A45D 2/24

[52] U.S. Cl. ..... 132/37 R

[58] Field of Search ..... 132/37 R, 33, 39; 219/431, 404, 348, 225

[56] References Cited

U.S. PATENT DOCUMENTS

| | | | |
|---|---|---|---|
| 744,426 | 11/1903 | Sterling | 132/37 A |
| 1,018,673 | 2/1912 | Madsen | 219/225 |
| 1,210,018 | 12/1916 | Trood | 132/37 R |
| 3,937,232 | 2/1976 | Tomaro | 132/37 R |
| 4,034,201 | 7/1977 | Walter | 132/37 R |

*Primary Examiner*—G. E. McNeill

*Attorney, Agent, or Firm*—George A. Ralston; William F. Frank

[57] ABSTRACT

A curling iron has a barrel and a hair-clamping arm pivotally mounted thereon for movement between an elevated position in which it projects angularly and forwardly relative to the barrel and a lowered hair-clamping position in which it is disposed alongside the barrel. A sleeve extends around the barrel and can be rotated and/or moved axially to cause movement of the hair-clamping arm into its elevated position against the action of a spring biassing that arm into its lowered position.

8 Claims, 11 Drawing Figures

CLAMPING ARM MECHANISM FOR CURLING IRON

FIELD OF THE INVENTION

The present invention relates generally to curling irons for curling the hair.

BACKGROUND OF THE INVENTION

A variety of different curling irons and styling devices are already available for curling or styling the hair. A typical curling iron as presently known consists of a cylindrical metal barrel containing an electrical heating element and having a handle at one end. A movable spring-loaded clamp or arm is positioned on the barrel so that a lock of hair can be clamped and wound around the barrel so that it may then be curled.

In many cases, some form of water reservoir is provided and a water delivery control system delivers water to the interior of the barrel so that steam may then be injected into the hair while or after it is wound around the barrel of the iron.

In order to use such curling irons effectively, especially with longer hair, it is necessary to clamp the ends of a lock of hair against the barrel using the hair-clamping arm and then to rotate the entire barrel and handle so as to wind the lock of hair around the barrel. Steam is then injected while the lock of hair is held tightly wound on the barrel, after which the clamping arm is released and the barrel is then withdrawn from the curl.

Difficulties arise during the use of such known curling irons since operation of the hair-clamping arms of such irons is generally effected by moving a button or knob and such operation is often possible only for a predetermined rotational position of the iron.

It is accordingly a principal object of this invention to provide a curling iron of the aforementioned type and which is more easily manipulated and operated by a user.

More particularly, it is an important object of this invention to provide a curling iron in which an improved mechanism is provided for moving the hair-clamping arm of such a curling iron between its lowered hair-clamping position and its elevated hair-releasing position.

A further object of this invention, in accordance with a preferred feature thereof, is to provide a curling iron having a handle which may be held in one hand while the other end of the curling iron is rotated to wind the hair about the barrel of the iron thereby providing greater control during the entire curling operation.

A further and incidental object of this invention is to provide a compact light-weight curling iron which may be conveniently carried in a handbag or purse.

Other objects of the invention will become apparent as the description herein proceeds.

SUMMARY OF THE INVENTION

A curling iron in accordance with this invention can be defined as comprising a generally cylindrical barrel; an electrical heating element within said barrel; an external electrical supply cord terminating within said curling iron; an electrical connecting means within said curling iron, connected to both said heating element and said electrical supply cord for the flow of electricity therebetween even during rotation of said barrel relative to said supply cord; a hair-clamping arm pivotally mounted on said barrel for movement between an elevated position in which it projects angularly and forwardly relative to said barrel and a lowered position in which it is disposed alongside said barrel in close proximity thereto; a spring means acting on said hair-clamping arm and urging that arm into said lowered position thereof; and a manually operable arm-lifting sleeve extending around said barrel and movable relative thereto to move said hair-clamping arm toward said elevated position thereof against the action of said spring means.

Usefully, the manually operable arm-lifting sleeve of a curling iron in accordance with this invention completely encircles the barrel of the iron so facilitating its operation irrespective of the rotational position of the iron. Such a sleeve can be provided so as to cause movement of the hair-clamping arm toward its elevated position on axial and/or rotational movement of such sleeve.

In accordance with a preferred feature of this invention, a curling iron in accordance therewith additionally comprises a handle at a rearward end thereof and a coupling means interconnecting such handle and the barrel for rotation of the barrel about its axis relative to the handle. It has been found that such construction with the barrel rotatable relative to the handle is advantageous in that it facilitates manipulation of the curling iron by allowing a user to hold the handle fixed in one hand and to rotate the barrel to wind a lock of hair therearound by turning the barrel using the other hand.

Usefully and generally, a curling iron in accordance with this invention will also comprise a water reservoir and a manually operable water delivery control system adapted to control the vaporization of water from said reservoir by said heating element and the discharge of resulting steam through discharge openings in the barrel of the iron. Such a water reservoir usefully extends axially forwardly from the barrel of the curling iron and is urged axially forwardly by a reservoir-biassing spring means within the barrel. Such a water delivery control system is adapted to permit the flow of water from within the reservoir for vaporization by the heating element on rearward axial movement of the water reservoir against the action of the reservoir-biassing spring means.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWINGS

The invention will now be described merely by way of illustration with reference to the accompanying drawings, in which.

DESCRIPTION OF THE PREFERRED EMBODIMENTS

Figure 1:
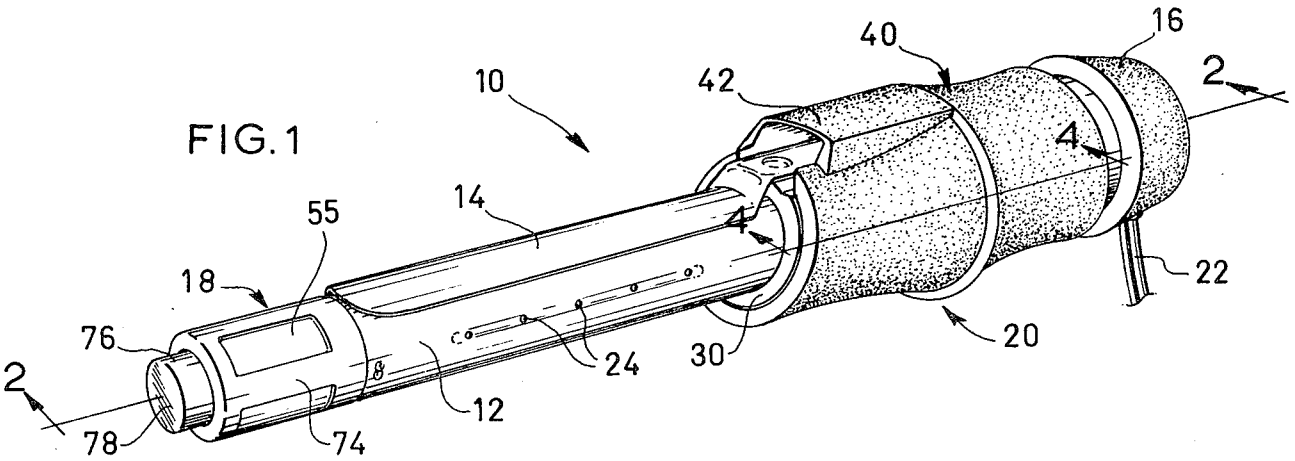
FIG. 1 is a perspective illustration of one embodiment of a curling iron in accordance with this invention.
Figure 2:
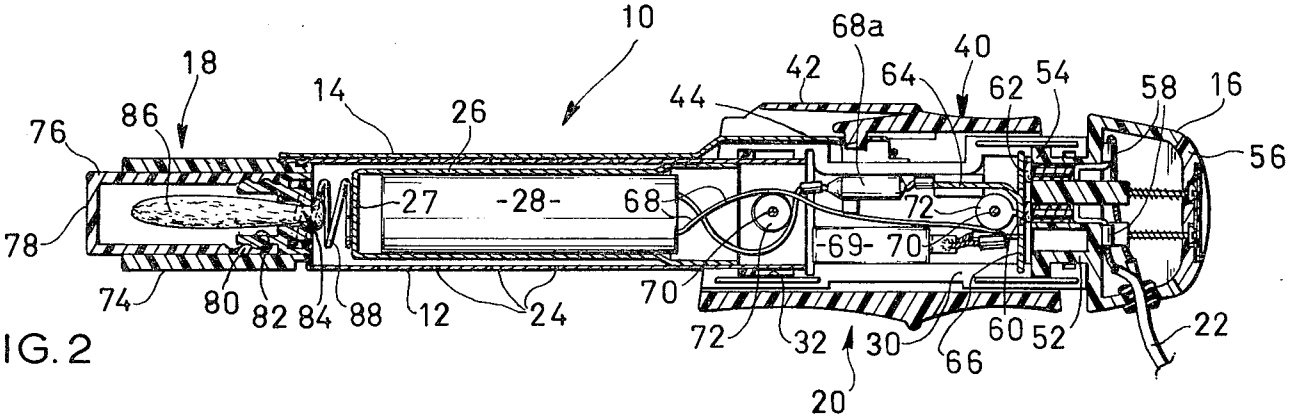
FIG. 2 is an axially sectional view through the curling iron shown in FIG. 1 when taken as indicated by the arrows 2—2 of that figure.
Figure 3:
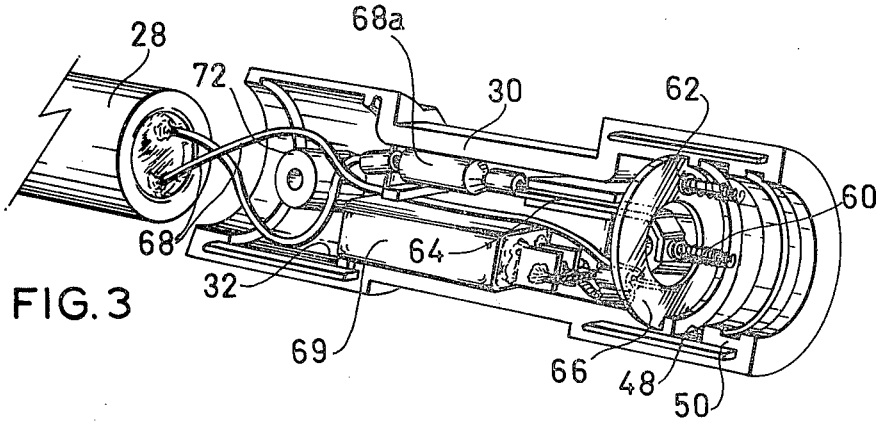
FIG. 3 is a fragmentary perspective view of part of the curling iron shown in FIGS. 1 and 2.

In FIGS. 1 and 2, there is shown generally at 10 one embodiment of a curling iron in accordance with this invention. The curling iron 10 comprises a generally cylindrical barrel 12 having a forward end portion generally indicated at 18, a movable hair-clamping arm 14 and a handle 16. The barrel 12 terminates rearwardly in a body portion generally indicated at 20 and by means of which it is connected to the handle 16 in a manner yet to be explained.

An electrical supply cord 22 extends from the handle 16 and is provided with any suitable plug (not shown) by means of which the curling iron can be connected to a source of electrical power.

Figure 4:
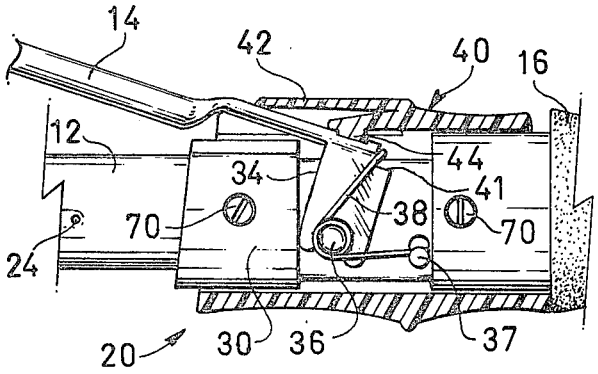
FIG. 4 is a fragmentary sectional view when taken as indicated by the arrows 4—4 of FIG. 1.

Turning now to FIGS. 2 and 4, the barrel 12 will be seen to be an elongated and generally cylindrical structure of a suitable metal, having spaced apart perforations 24 therethrough. In the interior of the barrel 12, there is provided a generally cylindrical metal liner 26 which has a closed forward end 27 and within which there is, in turn, disposed a generally cylindrical electrical heating element 28.

The rearward end of the barrel 12 is secured within a bore 32 in a two-part, elongated, hollow, tubular housing 30 which forms part of the body portion 20 as best shown in FIGS. 2 to 5.

Figure 5:
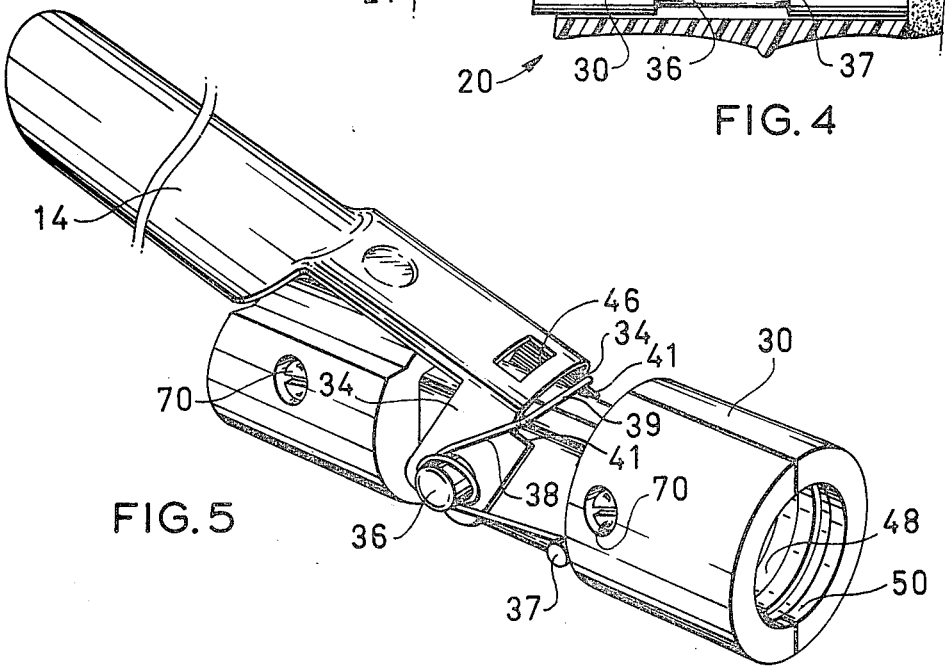
FIG. 5 is a fragmentary perspective view of part of the curling iron shown in the preceding figures.

The hair-clamping arm 14 is pivotally mounted on the housing 32 for movement between the elevated position shown in FIG. 5 in which the arm 14 projects angularly and forwardly relative to the barrel 12 and a lowered position as shown in FIG. 1 in which it is disposed alongside the barrel 12 and in close proximity thereto. For this purpose, the hair-clamping arm 14 is provided with two transversely spaced flanges 34 extending downwardly from the rear end of the arm 14 and pivotally mounted on pivot pins 36 provided on opposite sides of the housing 30. Any suitable spring means 38, which may conveniently be wrapped around the pivot pins 36, is provided for urging the hair-clamping arm 14 into its lowered hair-clamping position. The free ends of the spring 38 engage abutment pins 37 on the housing 30 while an intermediate portion 39 of the spring 38 engages shoulders 41 provided for such purpose at the rearward end of the arm 14.

The hair-clamping arm 14 is swung upwardly away from the barrel 12 and toward its elevated position as shown in FIG. 5 by means of a sleeve generally indicated at 40 which is slidably arranged around the exterior of the housing 30. A raised shroud portion 42 is formed in the sleeve 40 above the arm 14 to allow that arm free movement into its elevated position.

A tooth member 44 integrally formed with the sleeve 40 fits in a tooth-receiving recess 46 formed in the rearward end of the arm 14. As the sleeve 40 is moved manually and axially rearwardly along the housing 30, the tooth 44 causes the arm 14 to swing upwardly about the pivot pins 36 against the action of the spring means 38 and toward the elevated position of that arm. When the sleeve 40 is released, the spring means 38 forces the hair-clamping arm 14 back into its lowered position as shown in FIG. 1.

The housing 30 and the handle 16 are rotatably coupled and, for this purpose, the housing 30 is provided with an internal annular groove 48 which is, in turn, defined by an annular end flange 50. The handle 16 is provided with a coupling sleeve 52 which projects forwardly past the flange 50 and terminates in a radially outwardly projecting rib 54 rotatably received within the groove 48. It will now be understood that the body portion 20 including the housing 30 and the barrel 12 may be rotated relative to the handle 16, for example, by manually turning the forward end portion 18 of the barrel 12. To facilitate such rotation, the handle 16 is rounded, shaped and dimensioned so that it can readily be gripped in the palm of the human hand and is further usefully provided with an easily grippable surface finish. It may, for example, be provided with a knurled or roughened surface as shown in FIG. 1. For the same purpose, rectangular surface depressions 55 are usefully provided in the barrel end portion 18.

An end cap 56 closes the rearward end of the handle 16 within which the two wires of the electrical cord 22 are connected as is well known in the art to suitable electrical connectors such as those indicated at 58.

In order to provide for a rotatable electrical connection between the connectors 58 in the handle 16 and the heating element 28 in the barrel 12, the handle 16 is provided with two spring-biassed contacts, namely an axial contact 60 and a radially spaced apart contact 62, which are connected through the connectors 58 to respective ones of the wires of the cord 22.

Within the housing 30, there is provided a central axial contact 64 which contacts the contact 60 of the handle 16 and, radially spaced therefrom, an annular ring contact 66 which is contacted by the handle contact 62. Electrical wires 68 connect the contacts 64 and 66 to the heating element 28 for the supply of electrical power thereto. Thermofuse 68*a* and thermostat 69 are provided in the circuit in a conventional manner.

For convenience in manufacture, the housing 30 is preferably made as two generally semi-cylindrical mating halves which are fastened together, for example, by screws 70 received in mating sleeves 72 formed on both parts of the housing 30.

The forward end portion 18 of the barrel 12 is usefully in the form of a generally cylindrical member 74 which is fixedly secured to the barrel 12 and which is formed of any suitable thermally insulating material so that it will remain reasonably cool notwithstanding heating of the barrel 12 by the element 28.

Within the generally cylindrical member 74, there is provided a water supply system in turn comprising a smaller diameter generally cylindrical water reservoir 76 having a closed forward end 78 and an open and externally threaded rearward end 80.

A bushing 82 is axially movably disposed within the rearward end of the aforementioned forward end portion 18 of the barrel 12 and that bushing 82 is provided with an axial passageway 84 therethrough. Any suitable water-absorbent material such as a porous or fibrous wick 86 is fastened in the passageway 84 and projects rearwardly from the bushing 82 into the interior of the barrel 12. The bushing 82 is also formed with a rearwardly facing annular recess receiving the forward end of a helical compression spring 88, the rearward end of which bears against the forward end 27 of the liner 26. The bushing 82 is also provided with a male thread for releasably securing the reservoir 76 to that bushing.

Rearward manual pressure on the forward end of the water reservoir 76 causes rearward movement of the entire reservoir 76 and bushing 82 and the wick 86 is then caused to come into contact with the forward end 27 of the hot liner 26. Water in the wick 86 is then immediately vaporized and the resulting steam then passes outwardly through the perforations 24 in the barrel 12, having first passed through the annular space between the liner 26 and the inner surface of the barrel 12.

Having completed the description herein of the structure of the curling iron 10, the manner in which that iron is used and how it operates will now be briefly reviewed.

For such use, the user will first fill the reservoir 76 with water, plug in the cord 22 and wait for the liner 26 and barrel 12 to heat.

The handle 16 is then grasped firmly in the palm of one of the user's hands, typically the user's right hand. The sleeve 40 is then drawn rearwardly toward the handle 16 so as to raise the hair-clamping arm 14 into its elevated position. The iron 10 is then placed so that a lock of the user's hair is positioned between the barrel 12 and the arm 14 and the sleeve 40 is then released to allow the arm 14 to return to its lowered position (FIG. 1) to clamp the lock of hair against the barrel 12.

With the left hand, the user will then rotate the barrel 12 so to wind the lock of hair around the barrel 12 and over the clamping arm 14. During such winding and/or after such winding has been completed, the user can press the end 78 of the water reservoir 76 to cause vaporization of water within the iron and the discharge of steam through the perforations 24 into the hair wound around the barrel 12.

When a sufficient amount of heat and/or steam has been applied to the lock of hair, the clamping arm may be released by operation of the sleeve 40 to allow the iron to be withdrawn from within the curled lock of hair.

Throughout this operation, the user's right hand has been securely grasping the handle 16, the left hand then being solely used to cause the rotation of the barrel 12. This form of operation is very much more convenient than is the case with known curling irons where the rotation of the entire unit is achieved by movement of both the user's hands.

In addition, the provision of the sliding sleeve for elevating and releasing the hair-clamping arm 14 ensures that the arm 14 can be operated for any rotational position of the barrel 12 relative to the handle 16.

Having completed the description of the structure and use of the curling iron 10, reference will next be made to FIGS. 6 and 7 in which there is shown an alternative mechanism for elevating the hair-clamping arm 14. Instead of the sleeve 40, the mechanism of FIGS. 6 and 7 comprises a different form of sleeve generally indicated at 90. The sleeve 90 is rotatably mounted on a housing 92 corresponding to the housing 30 of the iron 10. For this purpose, the sleeve 90 is formed with a radially inwardly projecting rib 94 rotatably received in an annular peripheral recess 96 or groove in the housing 92.

At its forward end, the sleeve 90 is radially outwardly spaced apart from the barrel 12 but is integrally formed with an arcuate tongue 98 which curves axially inwardly through a transverse sector. The outer surface 100 of the tongue 98 provides a cam surface which engages a cam follower 102 on the undersurface of the arm 14 forwardly of the pivotpins 36 so that, on clockwise rotation of the sleeve 90 as indicated by the arrow A (FIG. 7), the cam follower 102 is moved radially outwardly causing movement of the hair-clamping arm 14 toward its elevated position.

Figure 7:
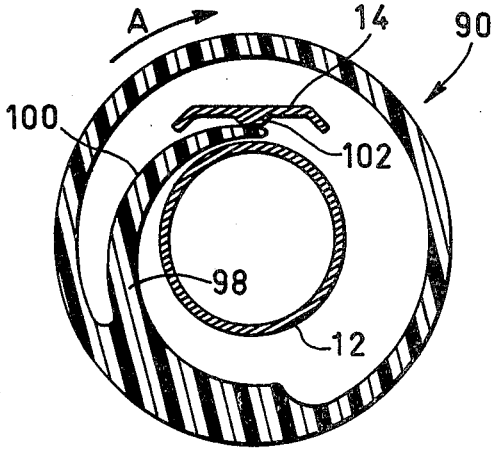
FIG. 7 is a transverse section when taken as indicated by the arrows 7—7 of FIG. 6 with certain parts omitted for the sake of clarity.
Figure 6:
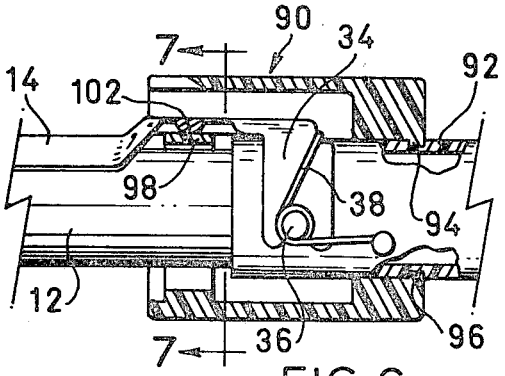
FIG. 6 is a fragmentary sectional view similar to that of FIG. 4 but showing an alternative mechanism for a curling iron in accordance with this invention.

The arm-elevating mechanism shown in FIGS. 6 and 7 has the same advantage as the sleeve 40 of the iron 10 in that it can be operated by the user regardless of the rotational position of the iron barrel 12.

Figure 8:
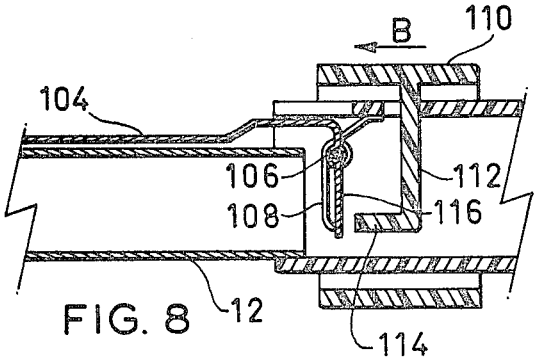
FIG. 8 is a section showing a further mechanism for a curling iron in accordance with this invention.

Referring now to FIG. 8 of the accompanying drawings, there is shown therein yet another mechanism for raising a hair-clamping arm 104 corresponding to the arm 14 of the iron 10. The arm 104 differs from the arm 14 in that it is pivotally mounted about different pivots 106 and is urged into its lowered position by a slightly different spring 108. An axially movable sleeve 110 is formed with a radially inwardly projecting leg 112 which is in turn provided at its lower end with a forwardly projecting foot 114 which engages a downward extension 116 of the arm 104 when the sleeve 110 is moved forwardly as indicated by the arrow B, so in turn to cause movement of the arm 104 toward its elevated position.

Figure 10:
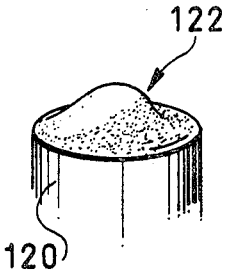
FIG. 10 is a fragmentary perspective view showing a cam surface provided in the mechanism shown in FIG. 9, and, FIG. 11 is a section showing an alternate form of rotary handle and coupling.

Finally reference will be made to FIGS. 9 and 10 of the accompanying drawings which show yet another arm-elevating mechanism for use in a curling iron in accordance with this invention. The mechanism shown in FIG. 9 comprises an axially movable and rotatable sleeve generally indicated at 118 which is integrally formed with a forwardly projecting axial shaft 120 which terminates at its forward end in a compound cam surface generally indicated at 122 and as best shown in FIG. 10. The cam surface 122 engages a mating rearwardly facing cam surface 124 of an axially movable but non-rotatable mechanical linkage 126 which is formed on its forwardly facing surface with an oblique surface 128 engaging a depending leg 130 provided on the rearward end of a hair-clamping arm 132. That arm 132 is pivoted at 134 and is urged into its lowered hair-clamping position by a helical compression spring 136 disposed within a bushing 138 and acting rearwardly on the leg 130 of the arm 132 as will be readily understood by reference to FIG. 9.

Figure 9:
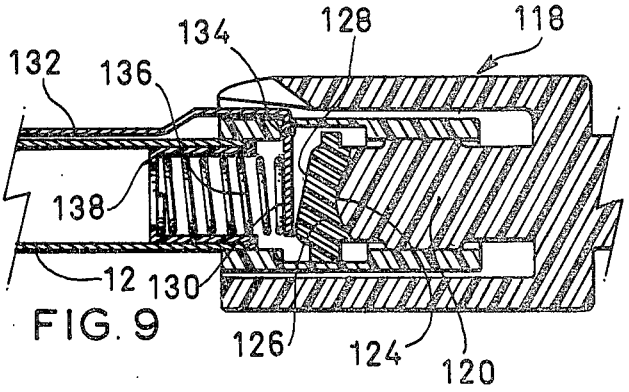
FIG. 9 is a section showing another mechanism for a curling iron in accordance with this invention.

The cam surfaces 122 and 124 are such that, when the sleeve 118 is rotated out of the position shown in FIG. 9, the resulting rotation of the shaft 120 and movement of the cam surface 122 over the cam surface 124 of the linkage 126 causes both forward movement of that linkage 126 and forward pivoting of the leg 130 and consequently movement of the hair-clamping arm 132 toward its elevated position.

In addition, the arm 132 can be moved toward its elevated position by forward axial movement of the sleeve 118 without rotation of that sleeve.

Figure 11:
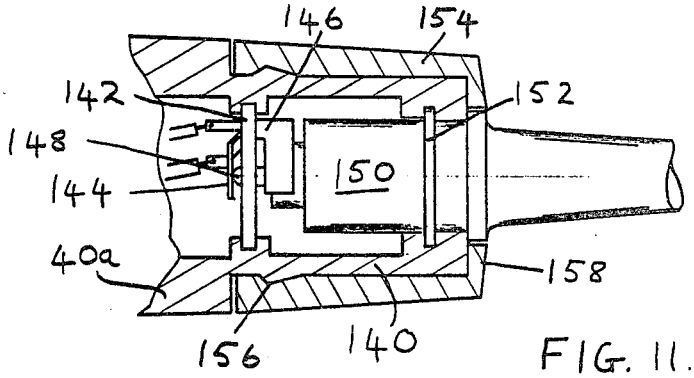

An alternate form of rotary handle and coupling may be used as shown in FIG. 11. A modified sleeve 40*a* has a rearward extension body 140 of reduced diameter. A rotary electrical connection is provided by means of ring 142 and central contact finger 144, mounted in extension body 140. Rotary connectors 146 and 148 engage ring 142 and finger 144, and are connected to electrical cable 150 which is rotatably held by annular flange 152 in body 140.

In order to permit the body 140 to rotate in the hand, an outer rotary collar 154 is rotatably mounted, by means of ridge 156. Collar 154 may be knurled, and has an end flange 158 for greater comfort.

While the invention has hereinbefore been specifically described with reference to the particular embodiments thereof as shown in the accompanying drawings, it should be understood that numerous variations in and modifications of the described structures are possible within the scope of this invention.

What is claimed is:

1. A curling iron having a generally cylindrical barrel, an electrical heating element within said barrel, and an electrical supply cord therefor, and wherein the improvement comprises:

a hair-clamping arm pivotally mounted on said barrel for movement between an elevated position in which it projects angularly and forwardly relative to said barrel and a lowered position in which it is disposed alongside said barrel in close proximity thereto;

a spring means acting on said hair-clamping arm and urging that arm into said lowered position thereof; and a manually operable arm-lifting sleeve extending around said barrel and movable relative thereto to move said hair-clamping arm toward said elevated position thereof against the action of said spring means.

2. A curling iron as claimed in claim 1 and in which said arm-lifting sleeve completely encircles said barrel.

3. A curling iron as claimed in claim 2 and in which said arm-lifting sleeve is adapted to move said hair-clamping arm toward said elevated position thereof on axial movement of said sleeve relative to said barrel in one axial direction.

4. A curling iron as claimed in claim 3 and in which said arm-lifting sleeve is adapted to move said hair-clamping arm toward said elevated position thereof on rearward axial movement of said sleeve relative to said barrel.

5. A curling iron as claimed in claim 2 and in which said arm-lifting sleeve is adapted to move said hair-clamping arm toward said elevated position thereof on rotation of said sleeve about said barrel.

6. A curling iron as claimed in claim 5 and in which said arm-lifting sleeve is adapted also to move said hair-clamping arm toward said elevated position thereof on axial movement of said sleeve relative to said barrel in one axial direction.

7. A curling iron as claimed in claim 6 and in which said arm-lifting sleeve is adapted to move said hair-clamping arm toward said elevated position thereof on rearward axial movement of said sleeve relative to said barrel.

8. A curling iron as claimed in claim 7 and which comprises an axially movable linkage within said curling iron axially movable therewithin to engage said hair-clamping arm and to move said arm toward said elevated position thereof on forward axial movement of said linkage, said linkage and said arm-lifting sleeve being provided with cooperating cam surfaces whereby said linkage is moved axially forwardly during both rotation and forward axial movement of said sleeve relative to said barrel.

* * * * *